US008002573B2

(12) United States Patent
Elsaesser et al.

(10) Patent No.: US 8,002,573 B2
(45) Date of Patent: Aug. 23, 2011

(54) CONNECTOR ARRANGEMENT FOR BRAIDED CONDUCTORS

(75) Inventors: Sven Elsaesser, Detmold (DE); Reinhard Nolting, Detmold (DE); Matthias Boensch, Bielefeld (DE)

(73) Assignee: Weidmueller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/627,499

(22) Filed: Nov. 30, 2009

(65) Prior Publication Data

US 2010/0159737 A1 Jun. 24, 2010

(30) Foreign Application Priority Data

Dec. 19, 2008 (DE) ..... 20 2008 016 801 U
Aug. 1, 2009 (DE) ..... 20 2009 010 474 U

(51) Int. Cl.
*H01R 4/24* (2006.01)

(52) U.S. Cl. ..... 439/416; 439/428

(58) Field of Classification Search ..... 439/415, 439/416, 411, 427, 428
See application file for complete search history.

(56) References Cited

U.S. PATENT DOCUMENTS

| | | | | |
|---|---|---|---|---|
| 4,240,687 | A * | 12/1980 | Bunnell et al. | 439/411 |
| 4,834,671 | A * | 5/1989 | Vigna et al. | 439/416 |
| 4,968,268 | A * | 11/1990 | Oh | 439/411 |
| 5,203,716 | A * | 4/1993 | Martucci et al. | 439/411 |
| 6,210,206 | B1 * | 4/2001 | Durham | 439/416 |

FOREIGN PATENT DOCUMENTS

| | | |
|---|---|---|
| DE | 6926918 | 11/1969 |
| FR | 1000882 | 2/1952 |

* cited by examiner

*Primary Examiner* — Hien Vu
(74) *Attorney, Agent, or Firm* — Lawrence E. Laubscher, Sr.; Lawrence E. Laubscher, Jr.

(57) ABSTRACT

An electrical connector for electrically connecting a hollow bus bar member with an insulated multi-wire or braided conductor inserted axially therein, including a conductive contact screw that is threadably connected within a first opening contained in the bus bar member wall for axial displacement from a retracted position toward a fully penetrating position, thereby to cause a pointed end of the contact screw to successively pierce the adjacent insulation layer, extend diametrically through the multi-wire conductor, pierce the adjacent layer of insulation, and extend into a second opening contained in the adjacent bus bar member wall. The bus bar member may be soldered to a printed circuit board, thereby to connect the multi-wire conductor with conductors on the printed circuit board. Alternatively, plurality of bus bar members may be formed by stamping and bending from a common conductive metal sheet, with the bus bar members being interconnected by integral straps.

10 Claims, 3 Drawing Sheets

CONNECTOR ARRANGEMENT FOR BRAIDED CONDUCTORS

BACKGROUND OF THE INVENTION

1. Field of the Invention

An electrical connector for electrically connecting a hollow bus bar member with an insulated multi-wire or braided conductor inserted axially therein, including a conductive contact screw that is threadably connected within a first opening contained in the bus bar member wall for axial displacement from a retracted position toward a fully penetrating position, thereby to cause a pointed end of the contact screw to successively pierce the adjacent insulation layer, extend diametrically through the multi-wire conductor, pierce the adjacent layer of insulation, and extend into a second opening contained in the adjacent bus bar member wall.

2. Description of Related Art

Insulation-penetrating connections for multi-wire and/or braided fine-strand conductors are known in the prior art, wherein one employs a piercing contact screw, and where the contact screw, during the contacting of the multi- and/or fine-strand conductor, penetrates into the latter, preferably in a radial diametric manner.

The purpose of the present invention is to provide such a connection device in a compact and stable manner using simple connector means. The electrical connection is to be particularly suitable also for assembly upon a printed circuit board.

The present invention solves this problem by means of a connection device for connecting at least one insulated multi-strand conductor with a bus bar member, wherein the bus bar member is hollow and forms a connection cage whose circumference is closed and where the connection cage on two places along its circumference is penetrated by a piercing contact screw, which contact screw is designed for contacting the multi- and/or fine-strand conductor through which it passes in the contacting state. In this way, by using simple connecting means, one can create a stable and reliable as well as also compactly structured connection device by means of which the multi-strand and fine-strand conductor to be contacted. If the insulated conductor has a corresponding diameter or if it is correspondingly dimensioned, during the contact process, the multi-strand and/or fine-strand conductor in the contacted state is so compressed that the insulation layer is pressed or clamped upon the interior circumference of the bus bar cage so that one can assure a stable, durable contact. Preferably, this contact cage is soldered upon a printed circuit board for which it is well suited because it consists of conducting metal, for example, a copper alloy.

Preferably, the bus bar member or cage has a rectangular shape so that in the assembled state it has a first leg resting upon the printed circuit board, two parallel lateral legs facing orthogonally away from the printed circuit board, and another leg spaced from and parallel with the first leg.

This bus bar member or connection cage can be made in a particularly simple manner in that the bus bar is bent from a conductive metal sheet to form a closed rectangle, especially a square. But the invention is not confined to making the connection cage in this fashion; the cage can also be made by other means. It is advantageous when, over the connection cage, one places a protective connection housing that can also be fixed upon the printed circuit board.

It is advantageous when the piercing contact screw consists of a conducting light-metal alloy, especially a copper alloy.

The invention also creates a connection unit for solar panels that has at least one connection device according to the present invention. It furthermore creates a terminal lock with one or several of the bus bar members connected together by integral connection straps.

SUMMARY OF THE INVENTION

Accordingly, a primary object of the present invention is to provide an electrical connector for electrically connecting a hollow bus bar member with an insulated multi-wire or braided conductor inserted axially therein, including a conductive contact screw that is threadably connected within a first opening contained in the bus bar member wall for axial displacement from a retracted position toward a fully penetrating position, thereby to cause a pointed end of the contact screw to successively pierce the adjacent insulation layer, extend diametrically through the multi-wire conductor, pierce the adjacent layer of insulation, and extend into second opening contained in the adjacent bus bar member wall.

According to a more specific object of the invention, the bus bar member may be soldered to a printed circuit board, thereby to connect the multi-wire conductor with conductors on the printed circuit board.

Another object of the invention is to provide a bus bar arrangement in which a plurality of bus bar members are formed by stamping and bending from a common conductive metal sheet, with the bus bar members being interconnected by integral straps.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
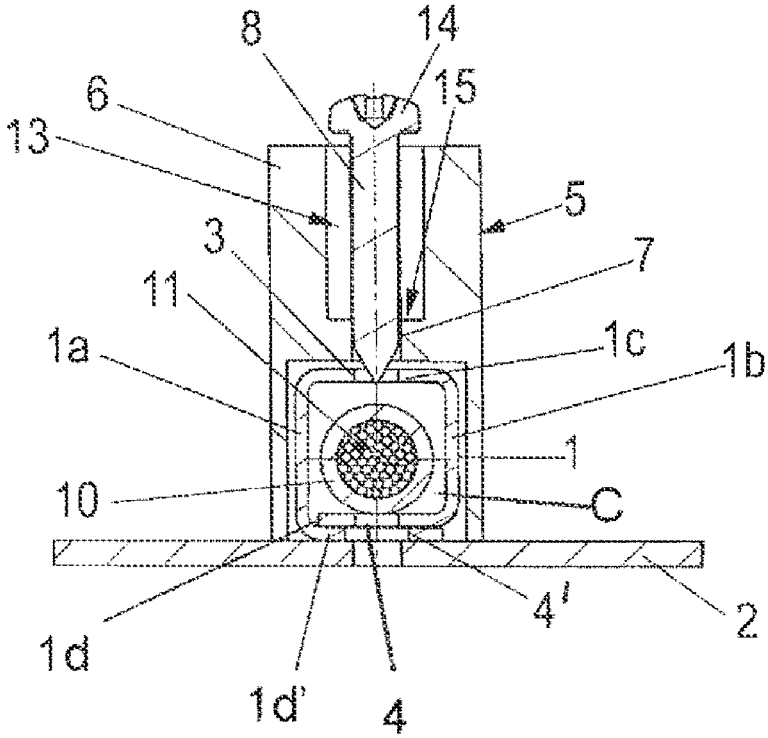
FIG. 1*a* is a sectional view illustrating the electrical connector with the contact screw in its retracted position relative to the bus bar member and the insulated multi-wire conductor.
Figure 1B:
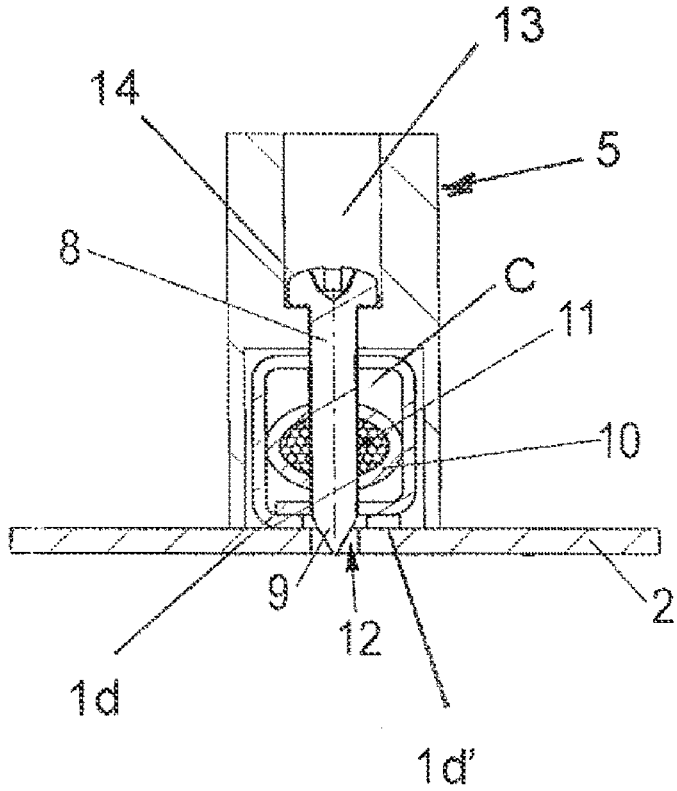
FIG. 1*b* is a similar view illustrating the contact screw in the fully penetrating position.
Figure 2A:
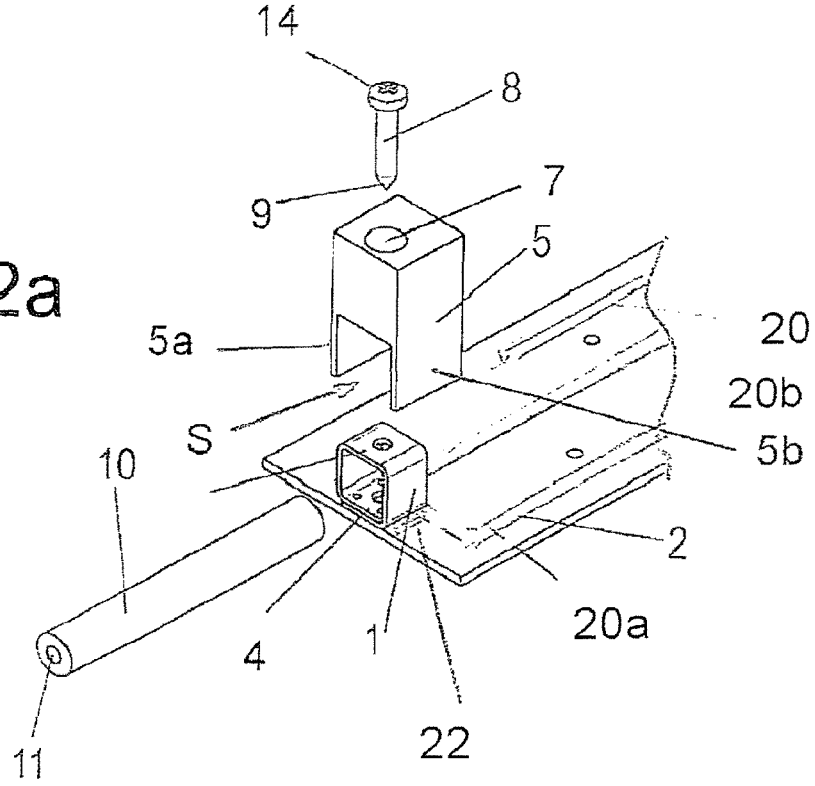
FIG. 2*a* is and exploded view of the electrical connector arrangement of FIG. 1*a*.
Figure 2B:
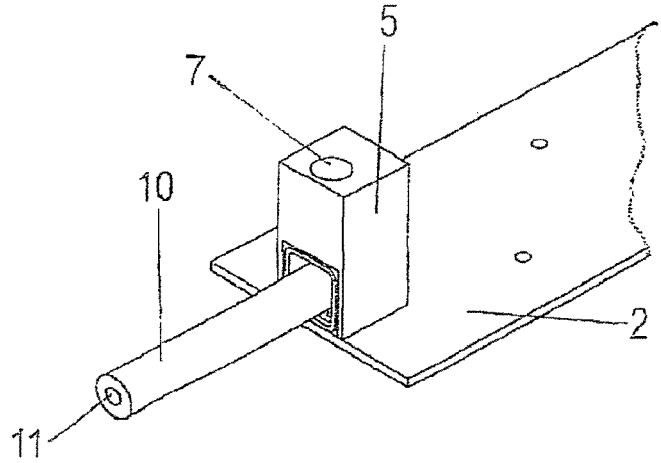
FIG. 2*b* is a perspective view of the connector apparatus in the assembler condition of FIG. 1*b*.

FIGS. 1 and 2 show a connection device that includes a bus bar member or connection cage 1, which is made up of a bus bar that is bent to form a closed rectangle, in particular, a square, whereby the free legs of the bus bar piece overlap each other on one side of the rectangle.

In the area of this side, bus bar member 1 is fastened to a printed circuit board 2, for example, by means of an SMD soldering process. The bus bar member includes a pair of vertical side walls 1*a*, 1*b*, a horizontal top wall 1*c*, and a bottom wall 1*d*. A horizontal fifth wall 1*d'* is bent from side wall 1*a* beneath the bottom wall 1*d*, which bus bar fifth wall is seated on and soldered 22 (FIG. 2*a*) to the printed circuit board 2, and is electrically connected with at least some (20*a*, 20*b*) of the conductors 20 of the printed circuit board.

In this way, bus bar member 1 forms two lateral legs 1*a, b* as well as a leg 1*c* facing away from printed circuit board 2 and a leg 1*d* resting on printed circuit board 2, in this case with double the wall thickness, whereby the two free ends of the bus bar walls 1*d* and 1*d*' can be stapled or otherwise secured together.

Leg 1*d* adjacent the printed circuit board 2 and parallel leg 1*c* spaced from the printed circuit board 2 contain mutually aligned screw threaded/holes 3 and 4, respectively. In the bus bar member fifth leg or wall 1*d*' resting upon printed circuit board 2, there is furthermore provided an oversized hole 4' with a somewhat larger diameter is provided.

Placed vertically above bus bar member 1 is a protective connector housing 5, which is formed of an electrically insulating synthetic plastic material and which can be fixed upon printed circuit 2, and which housing overlaps bus bar member 1 in a U-shaped pattern.

A vertical through bore 7 extends longitudinally through the housing, and a counterbore 13 extends downwardly from the upper end 6 of the housing to define a support surface 15 in the end 6 facing away from the printed circuit board 2 of connector housing 5. Adjoining this passage opening is a counterbored receiving area 13 for the enlarged screw head 14 of the piercing contact screw 8. In the receiving area, one can furthermore make a support surface 15 for the screw head 14.

Passage opening 7 as well as boreholes 3, 4 in the contacted state are penetrated by a piercing contact screw 8 that has a sharp pointed penetration tip 9, the outer peripheral surface of which preferably is provided with a cutting screw thread.

To contact a multi-strand and/or braided fine-strand conductor 11 surrounded by an insulation layer 10, the free end of the insulated conductor 11 is inserted axially into the chamber C of the hollow bus bar member land is pushed all the way through the latter, whereupon the piercing contact screw 8 is screwed from the retracted position of FIG. 1*a* toward the fully penetrating position of FIG. 1*b*, thereby passing through the threaded boreholes 3, 4, through the insulation layers, and through the multi-strand and/or braided conductor 11.

In the connection process, the insulation 10 of the multi-strand conductor 11 is penetrated, and the piercing contact screw 8 establishes an electrical contact between the bus bar member 1 and the multi- and/or fine-strand conductor 11, which are penetrated by individual strands in a geometric fashion of a circle cord (FIG. 1*b*).

Printed circuit board 2 is provided with a borehole 12 that is also aligned with boreholes 3, 4 so that the pointed tip of the piercing contact screw can protrude all the way into that opening.

Preferably, the multi- and/or fine-strand conductor 11 to be contacted and the bus bar member 1 are so dimensioned that the insulation of the multi- and/or fine-strand conductor 11 in the contacted state will be com pressed or clamped in a stable manner in engagement with the adjacent surfaces of the two side legs 1*a* and 1*b* of the bus bar member 1.

Piercing contact screw 8 preferably consists of a conducting light metal alloy, in particular, a copper alloy. Preferably, the openings 7, 3 and 4 are threadably connected with the contact screw 8.

Figure 3:
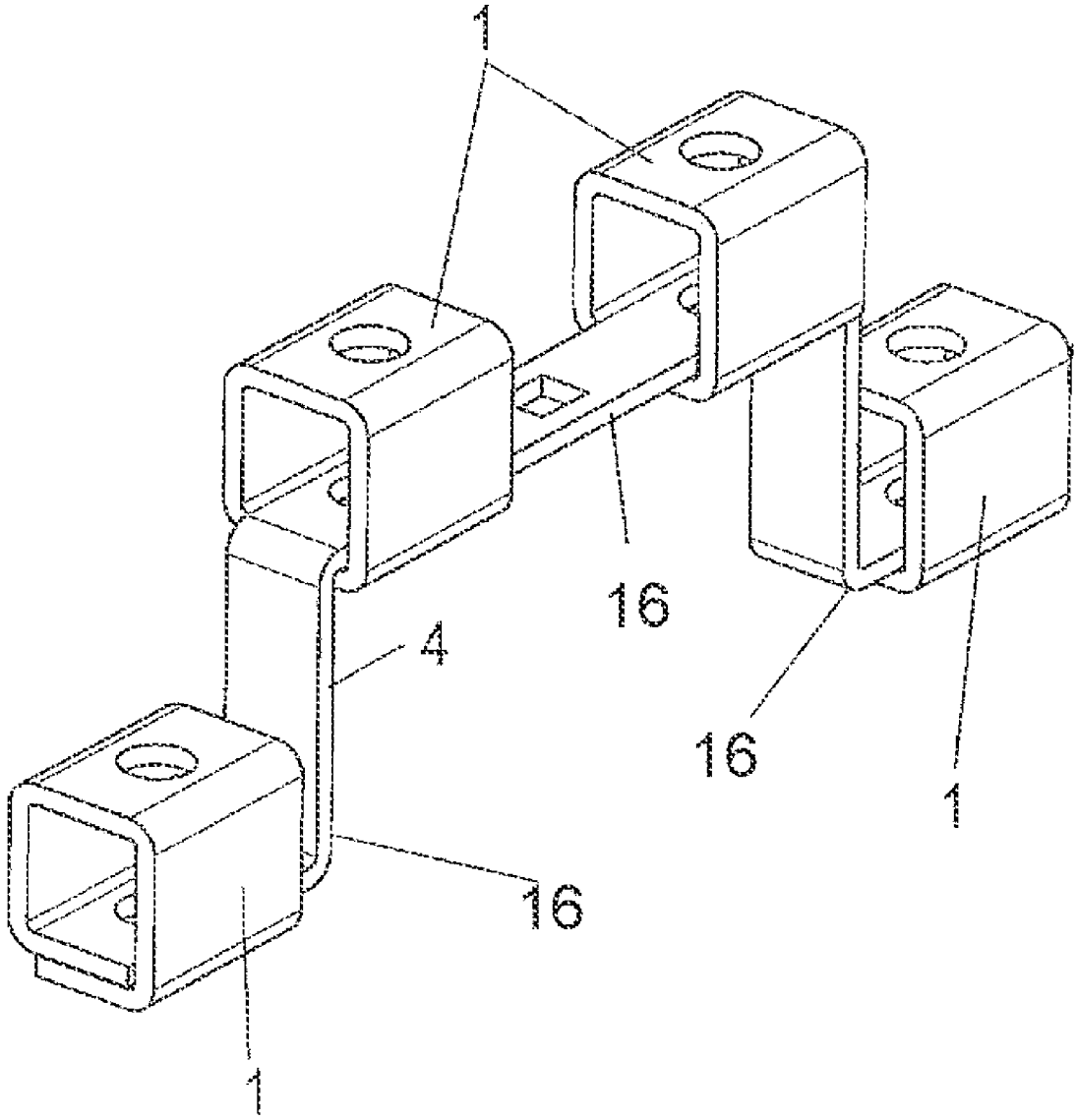
FIG. 3 is a perspective view illustrating a bus bar arrangement wherein a plurality of bus bar members are stamped and bent from a common conductive sheet and are interconnected by a plurality of integral straps.

Referring now to FIG. 3, a bus bar assembly including a plurality of bus bar members 1 is provided that is formed by punching and bending from a common conductive sheet. In this case, by way of example, four of the bus bar members 1 are made from one bus bar sheet material piece. The bus bar members are connected by integral strap portions 16. In this case, the bus bar assembly nevertheless is integral and made of one piece of sheet metal using the punch/bending method. Several bus bar members 1 are punched in a strip-like segment 16, which bus bar members are bent to form the bus bar members 1, each in this case having a rectangular profile and which otherwise can be structured according to FIG. 1. In this arrangement, however, the bus bar members will not rest on a printed circuit board. The bus bar assembly piece is preferably bent to have a stepped or graduated contour. The metal subassembly of FIG. 4 is suitable for use, for example, in a terminal block housing including corresponding connector housings 5. It can be supplemented at least by contact screws 8 in the manner of FIGS. 1*a* and 1*b*.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector for connecting a bus bar member to a multi-wire conductor (11) circumferentially enclosed by a layer of insulation (10), comprising:

(a) a hollow bus bar member (1) containing an open-ended horizontal chamber (C) for longitudinally receiving one end of the insulated conductor, said bus bar member being bent from electrically-conductive sheet metal and having a generally rectangular cross-sectional configuration including a pair of vertical spaced side walls (1*a*, 1*b*), and horizontal top (1*c*) and bottom (1*d*) walls containing opposed first (3) and second (4) openings, respectively;

(b) a horizontal printed circuit board (2) including a plurality of conductors mounted on an insulation base panel;

(c) said bus bar member further including a horizontal fifth wall (1*d*') extending from the lower edge portion of one of said vertical side walls between said horizontal bottom wall and said printed circuit board, said fifth wall being seated on said printed circuit board in electrical engagement with at least some of said conductors, said fifth wall being soldered to said printed circuit board, said fifth wall containing a third opening (4') opposite and aligned with said first and second openings: and (d) a vertical insulation-piercing electrically-conductive contact screw (8) having a threaded body portion extending through and threadably connected with said first opening (3), said contact screw being vertically axially displaceable between retracted and fully penetrating positions relative to said bus bar member, said contact screw body portion terminating at its lower end in a pointed first end portion (9) that, during longitudinal displacement of said contract screw from said retracted position toward said fully penetrating position, is operable to successively:

(1) pierce an adjacent first portion of the insulation layer;

(2) extend diametrically through the multi-wire conductor;

(3) pierce a diametrically opposed second portion of the insulation layer; and (4) extend into said second (4) and third (4') bus bar wall openings;

wherein said printed circuit board contains a fourth opening (12) receiving said contact screw pointed end portion when said contact screw is in said fully penetrating position.

2. An electrical connector as defined in claim 1, wherein said hollow bus bar member has a generally square cross-sectional configuration.

3. An electrical connector as defined in claim 1, wherein the distance between said bus bar walls (1*a*, 1*b*) is such that when said screw is displaced toward said fully penetrating position, the insulated conductor is compressed to effect engagement between diametrically opposed portions of the conductor insulation layer and the adjacent surfaces of said side walls.

4. An electrical connector as defined in claim 1, wherein said contact screw body portion is threadably connected with said second opening, said third opening being oversized relative to and spaced from said contact screw body portion.

5. An electrical connector as defined in claim 1, wherein said contact screw pointed end portion includes a cutting screw thread.

6. An electrical connector as defined in claim 1, and further including:

(e) a generally rectangular connector housing (5) formed of electrically insulating synthetic plastic material, said housing being vertically arranged and having a lower first end in seated engagement with said printed circuit board, said housing first end containing a slot (S) defining a pair of parallel housing walls (5*a*, 5*b*), said bus bar member being arranged within said slot with said third and fourth bus bar walls extending parallel with and adjacent said housing walls, respectively.

7. An electrical connector as defined in claim 6, wherein said connector housing contains a vertical longitudinal through bore (7) within which said contact screw body portion is mounted, the upper end (6) of said connector housing containing a counterbore (13) defining at its lower end a horizontal annular support surface (15); and further wherein said contact screw includes at it upper end an enlarged head portion (14) that is seated on said support surface when said contact screw is in said fully penetrating position.

8. An electrical connector as defined in claim 1, wherein said contact screw is formed from a conductive copper alloy.

9. An electrical connector as defined in claim 1, wherein a plurality of said bus bar members are punched and bent from a common sheet of conductive metal, of said bus bar member bottom walls being joined by integral connecting strap portions (16).

10. An electrical connector as defined in claim 9, wherein said connecting strap portions are bent to cause said bus bar members to have a stepped relationship.

* * * * *